US006206310B1

(12) United States Patent
Schneider

(10) Patent No.: US 6,206,310 B1
(45) Date of Patent: Mar. 27, 2001

(54) ROTARY MILL

(75) Inventor: Robert Schneider, Chaudfontaine (BE)

(73) Assignee: Magotteaux International, Vaux-Sous-Chevremont (BE)

( * ) Notice: Subject to any disclaimer, the term of this patent is extended or adjusted under 35 U.S.C. 154(b) by 0 days.

(21) Appl. No.: 09/424,095

(22) PCT Filed: Jul. 7, 1998

(86) PCT No.: PCT/EP98/04188

§ 371 Date: Nov. 18, 1999

§ 102(e) Date: Nov. 18, 1999

(87) PCT Pub. No.: WO99/03587

PCT Pub. Date: Jan. 28, 1999

(30) Foreign Application Priority Data

Jul. 17, 1997 (BE) ..... 9700626

(51) Int. Cl.[7] ..... B02C 17/22

(52) U.S. Cl. ..... 241/299; 241/183

(58) Field of Search ..... 241/182, 183, 241/299, DIG. 30

(56) References Cited

FOREIGN PATENT DOCUMENTS

1126709 * 3/1962 (DE) .

* cited by examiner

*Primary Examiner*—Mark Rosenbaum
(74) *Attorney, Agent, or Firm*—Schmeiser, Olsen & Watts

(57) ABSTRACT

The mill comprises a cylindrical shell (16) lined with an interior lining and intended to contain material to be ground and a charge of grinding implements, in which the lining, which is made up of rings of juxtaposed individual lining plates, has interior longitudinal lifting profiles to encourage the lifting of the charge and of the material to be ground as the mill rotates. In order to adapt the lifting profile to the parameters and conditions in which the mill operates, each plate has, on the rear face, when viewed in the direction in which the mill rotates, a step (10*b,* 12*b,* 14*b*) of a radial height that is taller than the front face, and each ring of plates comprises several different types of plate (10, 12, 14) which differ at least in terms of the radial height of their step (10*b,* 12*b,* 14*b*) and which follow on from one another, in the circumferential direction, in a determined order.

6 Claims, 4 Drawing Sheets

A
front
back
front
back
front
back
10
10a
12
14
18
20
22

REP A
REP C
REP U
REP B
REP A
REP 5A
REP 5B
10
10a
10b
12
12b
14
14b
18
20
22
24
26
28
Edg

ROTARY MILL

FIELD OF THE INVENTION

The present invention relates to a rotary mill comprising a cylindrical shell lined with an interior lining and intended to contain material to be ground and a charge of grinding implements, in which the lining, which is made up of rings of juxtaposed individual lining plates, has interior longitudinal undulations to encourage the lifting of the charge and of the material to be ground as the mill rotates.

BACKGROUND OF THE INVENTION

The invention is more specifically aimed at mills used in cement making and in the mining industry. These mills consist of a metallic cylindrical shell rotating about its longitudinal axis and containing a grinding charge made up of grinding implements, generally balls, but which may also consist of cylindrical pebbles, ball-shaped pebbles, etc. of varying size. The material to be ground is introduced from one side of the mill and, as it progresses towards the outlet, on the opposite side, it is ground and crushed between the grinding implements.

As the mill rotates, the material to be ground and the grinding charge are lifted up by the lining and, from a given instant, slide downwards again. It therefore follows that the charge of the mill is essentially concentrated in the fourth trigonometric quarter if the mill is rotating in the trigonometric sense, and in the third quarter if the mill is rotating clockwise, and occupies therein, in a radial plane, a "bean"-shaped area as shown in FIG. 4A of Belgian Patent Application 09301481. Grinding is achieved by the shear and frictional forces as the mass moves. To obtain effective grinding and avoid breaking the linings and the grinding implements, it is necessary for the lining to have a profile such that it lifts the charge up as far as a level such that this charge remains compact, because lifting it too much causes balls to be thrown out further than the base of the charge, that is to say that the balls directly strike the lining, without the interposition of material to be ground. From another viewpoint, the charge has to be lifted up high enough for there to be good agitation of the mass. It goes without saying that the fill co-efficient plays a deciding role in the efficiency of the grinding and that the bean-shaped area occupied by the charge has to be of a shape, position and size that are clearly determined in order to achieve effective and optimum grinding.

To encourage the lifting of the material and of the charge, it is known practice for longitudinal undulations which are adapted to the conditions and parameters in which the mill operates to be provided on the plates that form the interior lining of the mill. The problem, however, is that although the undulations or profiles of the grinding plates are adapted to a given mill, this will perhaps no longer be the case if the conditions change. It should in fact be pointed out that the lifting of the charge and of the material depends on a great many factors such as, for example, the size of the mill, its rotational speed, the size of the grinding implements, etc.

Furthermore, the lining plates are subject to intense wear which means that, even if the lifting conditions are optimum at the start, they may rapidly degrade as a result of the change in profile of the plates which is brought about by wear.

Known lining plates also have the handicap of being quite heavy, of the order of 40 to 50 kg, which means that handling them is difficult and dangerous. Reforms in health and safety at work legislation are in any case tending to forbid the handling of objects that weigh more than 25 kg.

Another constraint is that of replacing the worn plates and of attaching them to the shell, especially when they are bolted. In fact it should be pointed out that the shells have, so that the lining plates can be attached, drillings which are arranged generally according to a standard layout, but these standards may vary from one manufacturer to another. Any model of plate which does not suit these standardized drillings would lead to the need to make another drilling in the mill, something which cannot be envisaged because it is an extremely expensive operation which results in holing the shell and an increased risk of leakage of ground material.

Document DE 1126709 describes a mill in which the lining plates form steps in the direction of rotation. Various plates of differing radial depths follow on from one another in a determined order. The face with the greatest radial depth is at the front, when viewed in the direction of rotation. This has the drawback that the grinding implements are thrown, and this reduces the effectiveness of the grinding and increases the risk of the plates becoming broken. Furthermore, the steps of one ring are offset with respect to the steps of an adjacent ring, that is to say that the steps are not axially aligned. This gives rise to shear forces which increase the rate of wear of the plates on the edges.

Document WO 86/04267 also describes a mill in which the lining plates are arranged in steps to form lifting ramps. In this grinder, there is, in fact, just one type of step. Furthermore, the plates are bolted to the shell which means that the layout of the plates is restricted to the configuration of the holes in the shell.

In mills with stepped linings, the inclination of the ramps has to be increased when the diameter of the mill increases. In known mills, this leads to an increase in thickness of all the plates, which increases the total weight of the lining.

SUMMARY OF THE INVENTION

The object of the present invention is to provide a new type of lining which makes it possible to reduce the drawbacks described hereinabove and, more specifically, to provide a mill in which the lining is formed of lining plates which allow the lifting profile to be adapted to the parameters and conditions in which the mill operates, and which alters more gradually under the effect of wear.

In order to achieve this objective, the invention proposes a lining of the type described in the preamble, which is characterized in that each plate has, on the rear face, when viewed in the direction of rotation, a step of a radial height that is taller than the front face, in that each ring of plates comprises several different types of plate which differ, at least, in terms of the radial height of their step and in terms of the nature of their material and which follow on from one another, in the circumferential direction, in a determined order. A certain number of one of the types of plate are attachment plates bolted to the shell, all the other plates not necessarily being attached to the shell by bolts but being held in place by a simple arch bracing effect.

Given that several types of plate of differing shape are available, it is possible, through a judicious choice based on testing, to combine the various types of plate to form a clearly determined lifting profile which allows optimum lifting adapted to the conditions in which the mill operates.

According to another aspect of the invention, the various types of plate also differ in terms of the nature of their material. It is therefore possible to combine the various types of plate as a function of their risk of wear. It thus becomes possible to produce a lifting profile which is less vulnerable to wear, that is to say to conserve the initial lifting profile for longer. It is furthermore possible to combine the plates in an optimum way in order to have both good wear resistance and good impact resistance.

The lining plates, with the exception of the attachment plates, preferably comprise, on their radial faces, at least one longitudinal rib in the case of one and a corresponding longitudinal slot in the case of the other, or vice versa, so that they can nest together and be held in place by the attachment plates.

Given that most of the lining plates are not bolted to the shell but are simply held in place by nesting together, there are fewer constraints due to the arrangement of the drill holes in the shell when installing such a lining.

Each of the plates is preferably sized so that it does not exceed a weight of 25 kg. This lower weight makes the plates easier to handle and lies within the limits imposed by the new regulations. Furthermore, smaller and more compact plates allow the use of less resilient steels or cast irons, which makes it possible to choose better compromises between wear and impact resistance than is the case with conventional linings.

BRIEF DESCRIPTION OF THE DRAWINGS

Other specific features and characteristics will emerge from the description of a few advantageous embodiments presented below by way of illustration with reference to the appended drawings, in which.

DETAILED DESCRIPTION OF THE INVENTION

Figure 1:
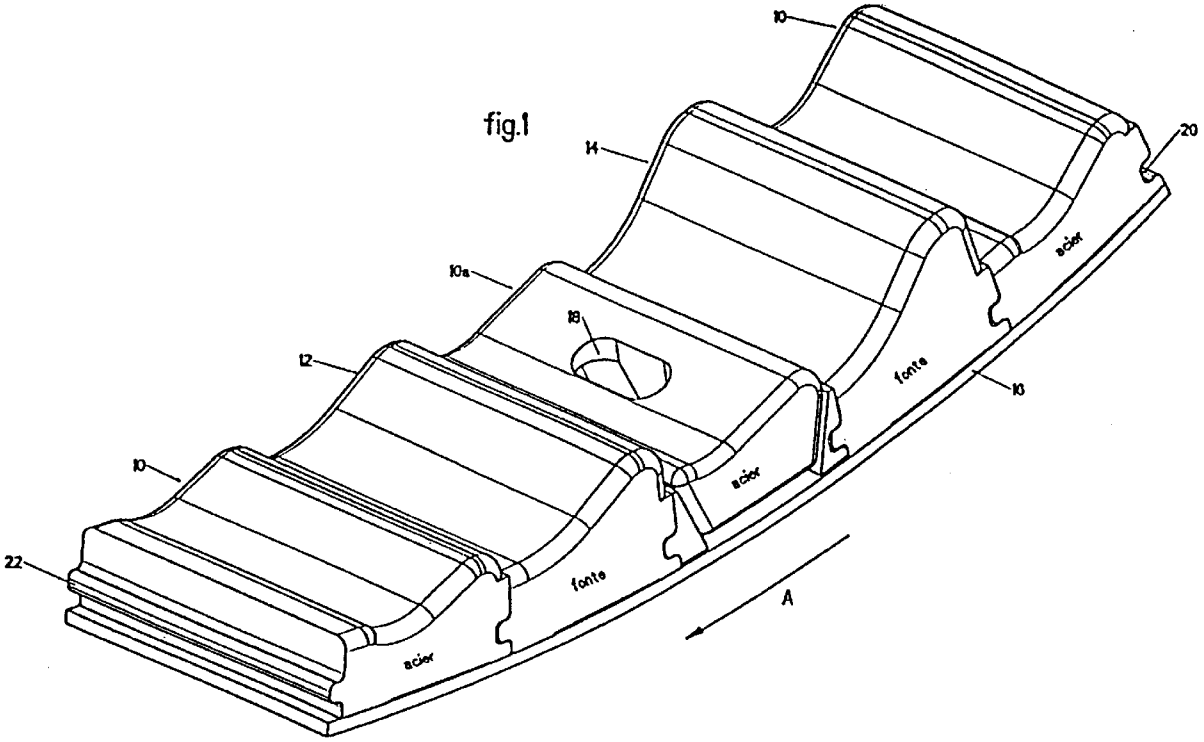
FIG. 1 shows a perspective view of an assembly of three types of lining plate.
Figure 2:
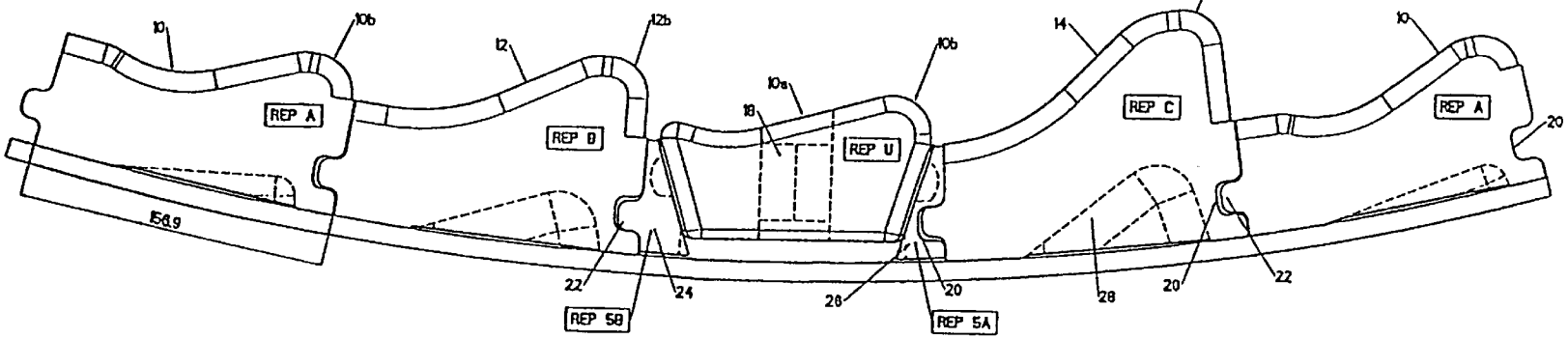
FIG. 2 shows a side view of the plates of FIG. 1.

FIGS. 1 and 2 show different types of lining plate 10, 10*a*, 12 and 14 having an outer face that is slightly curved in order to match the interior face of the cylindrical shell of the mill depicted diagrammatically by the reference 16. When viewed in the direction in which the mill rotates, which is depicted by the arrow A, all the plates have a front face, the height of which is less than that of the rear face so as to define a step at the rear side of each plate, which step comprises a rounded portion 10*b*, 12*b*, 14*b*, so that juxtaposing the plates creates an undulating profile.

The various types of plate differ at least in terms of the height of their rear face, that is to say the height of their step 10*b*, 12*b* and 14*b*. Thus, the step 14*b* of the plates 14 is more pronounced than the step 12*b* of the plates 12 which, in turn, is more pronounced than the step 10*b* of the plates 10 or 10*a*. From the point of view of the contribution made to the shape of the interior profile, the plates 10 and 10*a* are identical, given that they have the same step. The plates 10 and 10*a* can therefore be considered as being of the same type, which means that FIGS. 1 and 2 show three different types of plate.

However, unlike the plates 10, the plates 10*a* are attachment plates and, for this purpose, have a central opening 18 so as to be bolted to the shell 16 through a drilling in the shell 16.

All the plates other than the plates 10*a* are not attached directly to the shell 16 but are simply held in place by an arch bracing effect and by nesting together. For this, each plate has, on the rear face, along the entire length, a slot 20 and, on the front face, has a corresponding rib 22 that can fit into the slot 20 of the previous plate. The slots 20 and the ribs 22 may, of course, be the other way round.

The attachment plates 10*a* have neither rib nor slot. The front and rear faces are smooth and re-entrant, thus converging towards the shell 16. Wedging is achieved using wedges 24 and 26 of triangular section which are inserted between the attachment plates and the neighbouring plates. These wedges 24 and 26 have inclined interior faces that complement the inclined faces of the attachment plate 10*a*. The outer faces of the wedges 24 and 26 are straight and have a slot 20 or respectively a rib 22 to fit over the rib 22, or respectively into the slot 20 of the adjacent plates. Thus, clamping the attachment plate 10*a* to the shell 16 generates a tangential parting force which is transmitted to the adjacent plates and keeps them nested solidly together. By using wedges of varying thickness, it is possible to determine the amount of clamping, particularly so as to be able to take up any play during operation.

The various types of plate 10, 12 and 14 may differ, apart from in terms of the height of their step, in terms of the nature of the material or alloy from which they are made. Thus, the plates that are most exposed to wear, in particular the plates 12 and 14 with the most pronounced step, may be made of a cast iron with a high wear resistance, and the plates 10 which are less exposed may be made of steel. This then helps with more uniform wear, which maintains the initial lifting profile for longer.

The overall dimensions of the various plates are preferably such that their weight does not exceed 25 kg. To lighten the plates, it is possible in particular for their outer side, on the shell side, to have hollows, as indicated schematically by broken line 28.

By making a judicious choice from the various available types of plate, and alternating them in a clearly determined combination, it is possible to adapt the profile of the lifting plates to suit the parameters and conditions in which the mill operates so that the lifting of the material and of the charge is sufficient without grinding implements being thrown out, that is to say so that the mass occupies the ideal bean shape that encourages optimum grinding.

This possibility of making a choice between various types of plate allows an appreciable reduction in the weight of the lining. Thus, a lining with the combination of plates according to FIG. 5 in a mill that has a diameter of 5.2 m has a weight/m$^2$ of 525 kg, whereas a conventional lining using mutually identical plates has a weight of 668 kg/m$^2$ for a mill of the same diameter and for a comparable lifting effect.

If the conditions in which the mill operates change for any reason, it is possible, at any moment, to change the type of plate and/or combination in order to regain the ideal undulating profile.

Figure 3:
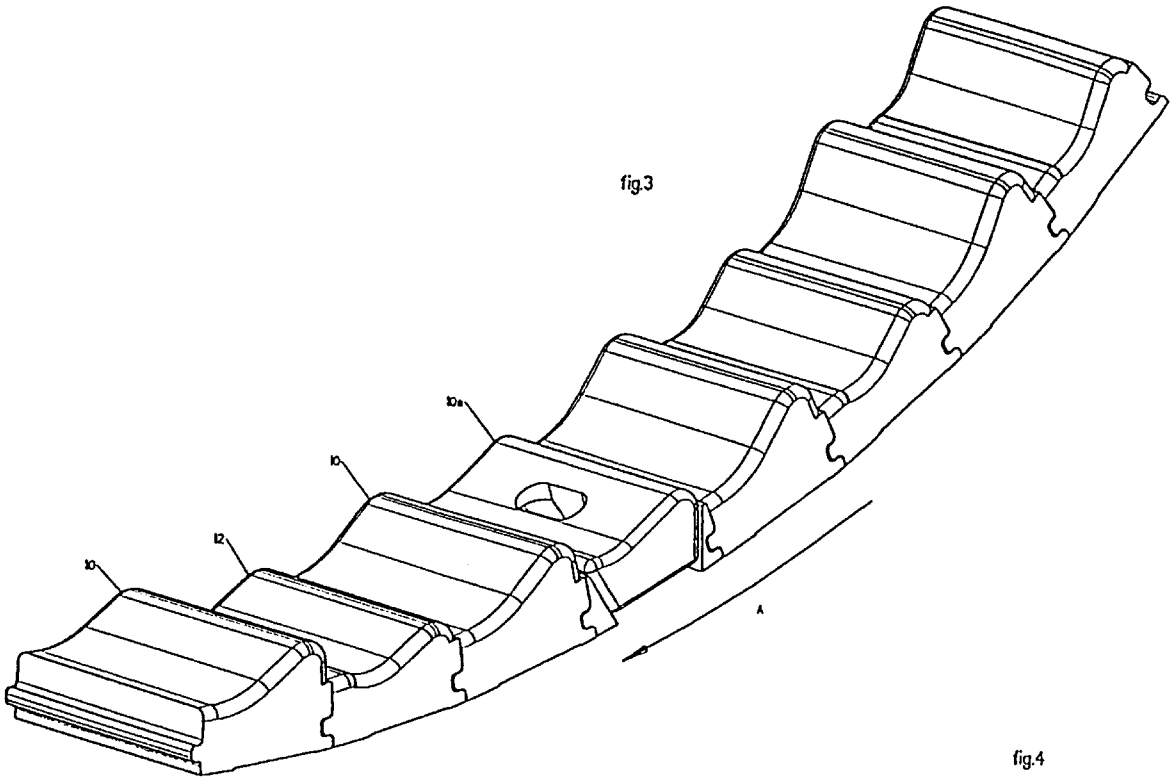
FIG. 3 shows part of a ring of lining plates that consists of a combination of two types of plate chosen from among the three types in FIG. 1.
Figure 4:
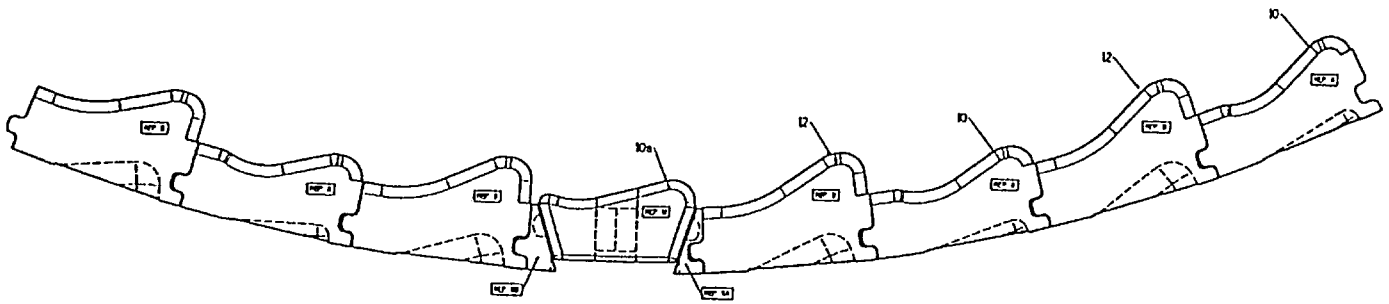
FIG. 4 shows a lateral view of the combination of FIG. 3.

FIGS. 3 and 4 show a first example of an arrangement of plates in which use is made of just the two types of plate 10 and 12, and according to which, next to each plate of one type, 10 or 12, are placed two plates of the other type, 12 or 10.

Figure 5:
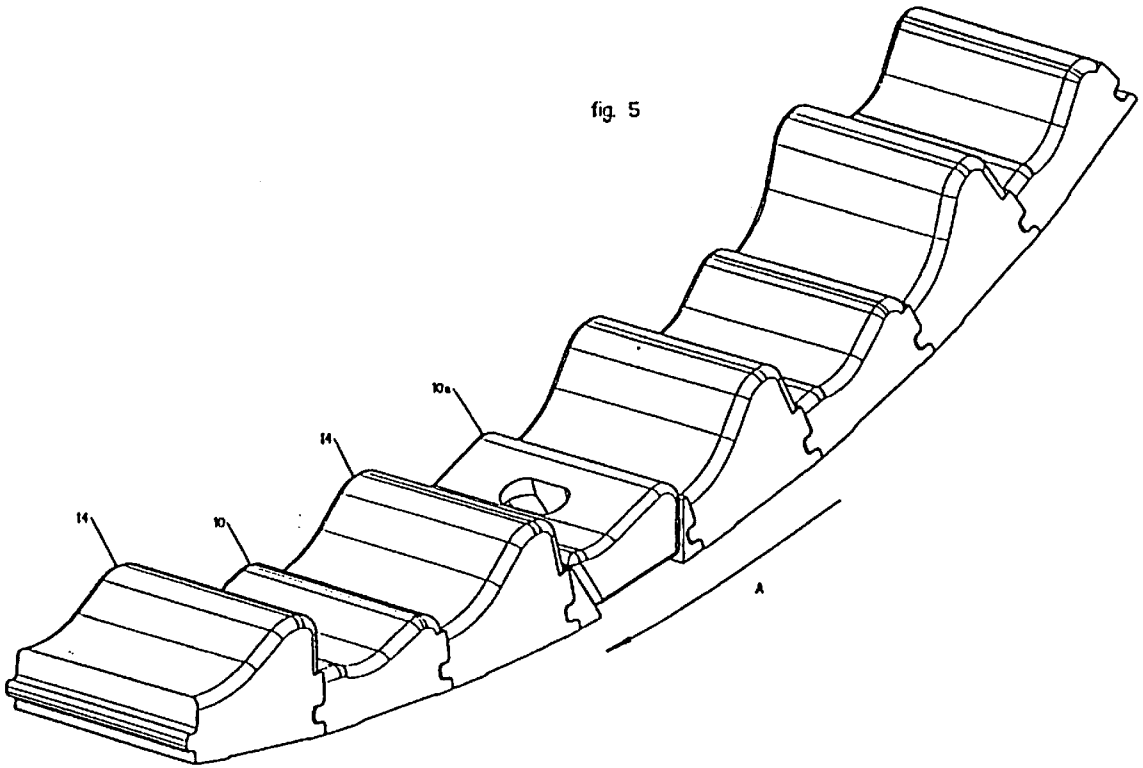
FIG. 5 shows a view similar to that of FIG. 3 with another combination of two types of plate.
Figure 6:
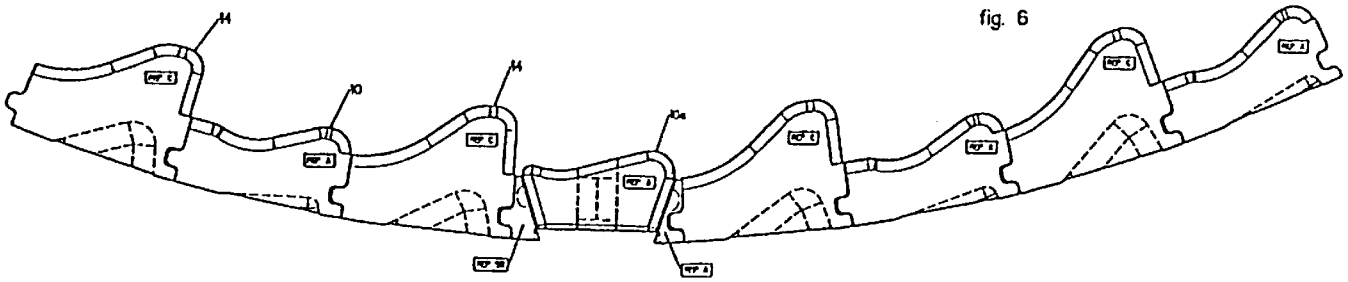
FIG. 6 shows a lateral view of the combination of FIG. 5.

FIGS. 5 and 6 illustrate an arrangement similar to the previous one, but here, the plates of type 10 are alternated with those of type 14.

Figure 7:
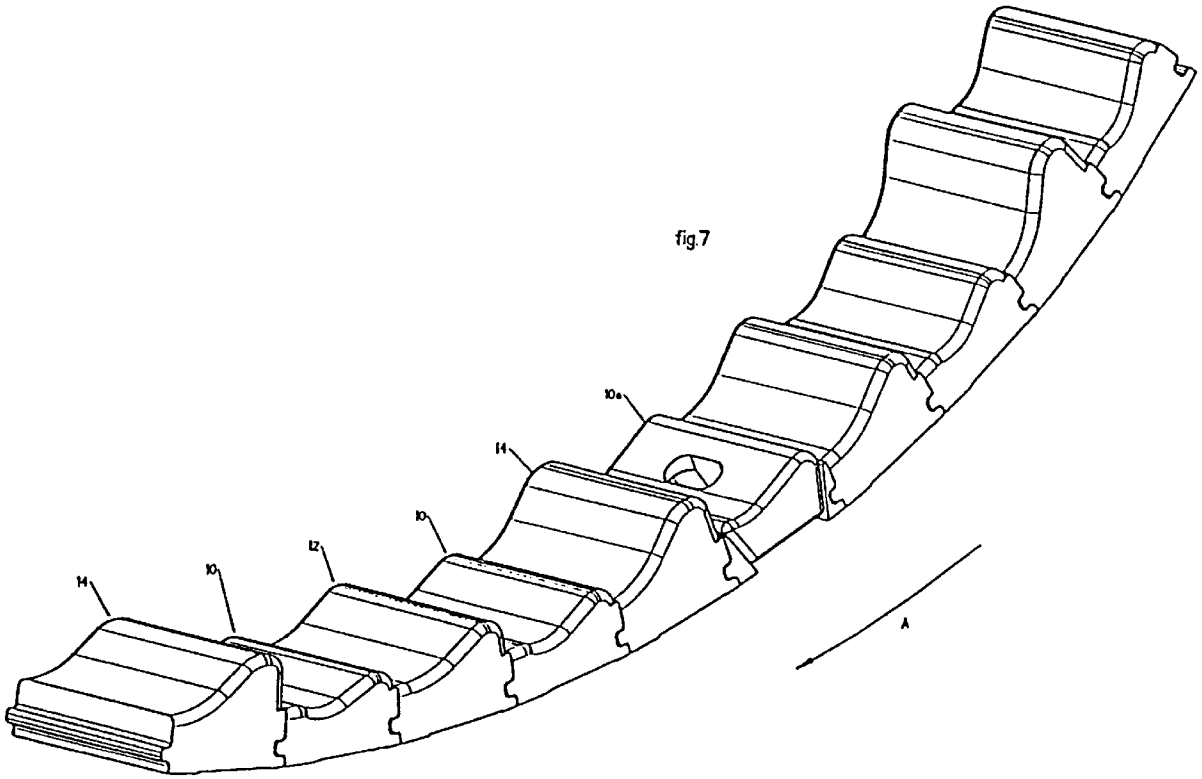
FIG. 7 shows part of a ring of lining plates that consists of a combination of the three types of plate in FIG. 1.
Figure 8:
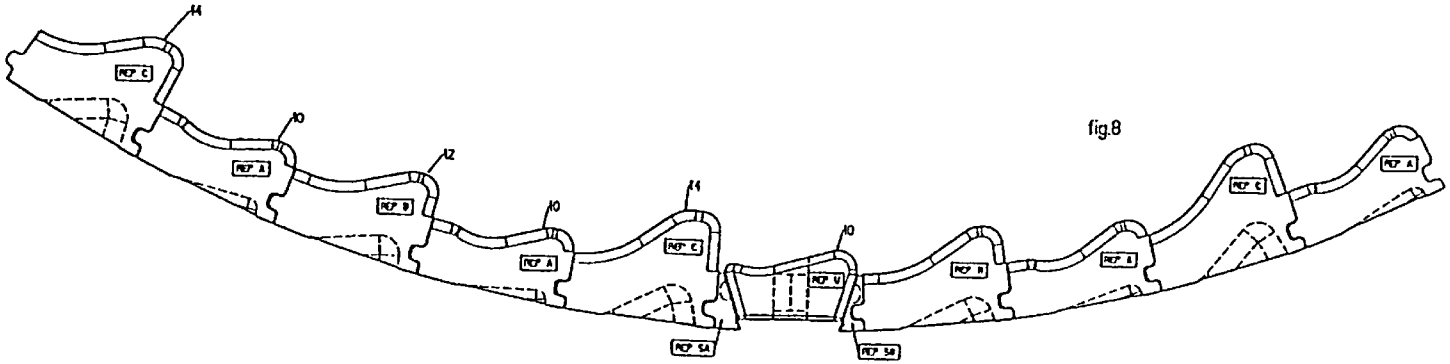
FIG. 8 shows a lateral view of the combination of FIG. 7.

FIGS. 7 and 8 illustrate an example of an arrangement with a double alternation of the three types of plate 10, 12 and 14. The combination chosen is: 10-12-10-14-10-12 . . . , that is to say that there are twice as many plates of type 10 as there are of type 12 or of type 14.

It is, of course, possible to envisage combinations other than those mentioned above by way of examples. Likewise, it is possible to provide more than three different types of plate.

Furthermore, it may be, within one and the same mill, that the grinding conditions differ from the inlet side to the outlet side, particularly as a result of the gradual grinding and of the changing particle size of the material to be ground. To adapt the profile of the lifting plates to suit these differing conditions, it is possible, within one and the same mill, to provide plate types and/or combinations at the inlet side which differ from those at the outlet side.

The invention has therefore provided a new mill with a lining that is perfectly modifiable and adaptable to varying conditions and parameters.

What is claimed is:

1. Rotary mill comprising a cylindrical shell (16) lined with an interior lining and intended to contain material to be ground and a charge of grinding implements, in which the lining, which is made up of rings of juxtaposed individual lining plates, has interior longitudinal lifting profiles to encourage the lifting of the charge and of the material to be ground as the mill rotates, characterized in that each plate has, on the rear face, when viewed in the direction in which the mill rotates, a step **(10*b*, 12*b*, 14*b*) of a radial height that is taller than the front face, in that each ring of plates comprises several different types of plate (10, 12, 14) which differ in terms of the radial height of their step (10*b*, 12*b*, 14*b*) and in terms of the nature of their material, which follow on from one another, in the circumferential direction, in a determined order, and which are axially aligned and in which a certain number of one of the types of plate (10) are attachment plates (10*a*) bolted to the shell (16), all the other plates not being attached to the shell (16)** by bolts but being held in place by a simple arch bracing effect.

2. Mill according to claim 1, characterized in that the plates with the most pronounced step are made of cast iron and the plates with the least pronounced step are made of steel.

3. Mill according to claim 1, characterized in that all the lining plates, with the exception of the attachment plates **(10*a*), comprise, on their front face and on their rear face, at least one longitudinal rib (22) in the case of one and a corresponding longitudinal slot (20) in the case of the other, or vice versa, so that they can nest together and be held in place between the attachment plates (10*a*)**.

4. Mill according to claim 3, characterized in that the rear and front faces of the attachment plates **(10*a*) converge towards the shell (16) and are separated from the adjacent lining plates by wedges (24, 26) which, on their outer face, have a slot (20) or respectively a rib (22) to fit over the rib (22), or respectively into the slot (20)** of each adjacent plate.

5. Mill according to claim 4, characterized in that the wedges (24, 26) are of varying thicknesses.

6. Mill according to claim 1, characterized in that each type of plate has a weight of less than 25 kg.

* * * * *